US006347757B1

(12) United States Patent
Takahashi et al.

(10) Patent No.: US 6,347,757 B1
(45) Date of Patent: Feb. 19, 2002

(54) COAL MILL AND REDUCTION GEAR USED THEREFOR

(75) Inventors: Takeo Takahashi, Tsuchiura; Nobuo Shiiba; Masanori Katayama, both of Chiyoda, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/526,537

(22) Filed: Mar. 16, 2000

(51) Int. Cl.[7] ..... B02C 15/04
(52) U.S. Cl. ..... 241/121; 184/6.22; 241/107
(58) Field of Search ..... 241/107, 117, 241/121, 17, 24.24; 184/6.22; 74/467

(56) References Cited

U.S. PATENT DOCUMENTS 1,523,881 A * 1/1925 Kreutzberg ..... 241/121
5,220,978 A * 6/1993 McMaster ..... 184/6.22

FOREIGN PATENT DOCUMENTS

CH 630 537 A5 6/1982
DE 41 40 667 A1 6/1993

* cited by examiner

*Primary Examiner*—Lowell A. Larson
(74) *Attorney, Agent, or Firm*—Antonelli, Terry, Stout & Kraus, LLP

(57) ABSTRACT

A coal mill introduces raw coal between a roller and a ring and pulverizes the raw coal. A reduction gear for a mill is provided in a lower portion of the coal mill. A cooling fan is mounted to an input shaft of the reduction gear for the mill which is connected to a motor. A radiator for cooling a lubricating oil which lubricates within the reduction gear for the mill is arranged in an extending portion of the input shaft. An oil pump and a line filter are provided in a lubricating passage which supplies the lubricating oil to the radiator, and a flexible pipe connects between these elements. Accordingly, the coal mill is cooled by air.

9 Claims, 4 Drawing Sheets

COAL MILL AND REDUCTION GEAR USED THEREFOR

BACKGROUND OF THE INVENTION

Field of the Invention

The present invention relates to a pulverizing mill and a reduction gear used therefor, and particularly to a coal pulverizing mill and a reduction gear used therefor.

In order to pulverize coal so as to be used for a thermal power generation, a coal mill has been conventionally employed. In this coal mill, coal prior to a pulverization is supplied from a coal supplying port provided in an upper portion. Then, several pulverizing rollers provided in a middle portion pulverize the coal dropping down between the pulverizing roller and a pulverizing ring on which a groove of the roller is formed. A reduction gear which transmits power for rotating the pulverizing ring is arranged below the pulverizing ring. Then, a direction of rotation is converted from a direction of a horizontal axis into a direction of a vertical axis by this reduction gear. An electric motor serving as a driving apparatus is connected to an input side of the reduction gear.

Embodiments of the coal pulverizing mill are described in U.S. Pat. No. 4,972,099 and Japanese Patent Unexamined Publication No. 5-288335, and an example of the reduction gear used therefor is described in Japanese Patent Unexamined Publication No. 8-89828.

In recent years, the capacity of the coal mill for the thermal power plant is increased, and the size of the pulverizing ring is enlarged. In a typical structure thereof, a diameter of the pulverizing ring is increased to 3 m. As a result, an amount of the coal which can be pulverized is significantly increased and a diameter of the coal is significantly reduced in comparison with those in the conventional structure, however, power of the pulverizing ring is increased and load of the reduction gear for transmitting the power is increased. Further, concerning a power plant in which the coal mill is placed, a plurality of, for example, five or six coal mills are placed in one power plant in place that only one coal mill is placed there. In the power plant in which a wide space is required as mentioned above, it is not preferable to employ a cooling water for cooling lubricating oil which lubricates bearings and gears used for the reduction gear and the mill in view that it is necessary to secure a piping space and a freedom of mutual arrangement of the mills is reduced.

In this case, in U.S. Pat. No. 4,972,099 mentioned above, various problems in lubricating the coal mill are listed up and it is described that auxiliary lubricating means is provided for solving the problems. Then, by filtering the lubricating oil so as to remove a contaminant contained in the lubricating oil from the lubricating oil, bearings and gears used for a ball mill are prevented from being abraded. As a result, it is possible to prevent the lubricating oil from being deteriorated due to the mixed material into the lubricating oil and prevent the lubricating parts such as the reduction gear and the like from being abraded, however, the other lubricating means is provided in addition to the normal lubricating means, so that the apparatus becomes complex.

Further, Japanese Patent Unexamined Publication No. 5-288335 describes pulverizing the coal by the coal mill and providing a gear box in a lower portion of the mill main body, however, does not disclose lubricating each of the members in the mill. Further, Japanese Patent Unexamined Publication No. 8-89828 describes setting a thrust bearing of the reduction gear for the mill to a tilting pad bearing in order to reduce vibration and noise, and positioning a center of the spherical surface of the pads between the inside and the outside of the case to which a thrust force is applied. However, also in this publication, no sufficient consideration is taken into cooling the lubricating oil and the lubricating portion in order to intend to reduce a space of the bearing for the mill or simplify the bearing for the mill.

In this case, an embodiment in which an air cooling structure is employed for intending to simplify the reduction gear is described in Japanese Patent Unexamined Publication No. 4-4349, however, the reduction gear is a common reduction gear, and no consideration is given to conditions for using the reduction gear for the mill such as a high temperature, a lot of dusts, heavy shock load of each of the gears in the reduction gear, and the like.

BRIEF SUMMARY OF THE INVENTION

An object of the present invention is to provide a reduction gear for a coal mill which has a high reliability even in a condition that an environment around the coal mill is not good and which is provided with a simple cooling mechanism. Another object of the present invention is to provide a reduction gear for a coal mill in which a maintenance period is made long so as to improve an operability.

In order to achieve the objects mentioned above, in accordance with a first aspect of the present invention, there is provided a coal mill having several pulverizing rollers and a pulverizing ring on which a groove is formed, thereby pulverizing coal introduced between the pulverizing rollers and the pulverizing rings, comprising a reduction gear for a mill which transmits power for rotating the pulverizing rings from a motor to the pulverizing rings, a cooling fan which is provided in an input shaft of the reduction gear for the mill connected to the motor, and a radiator for cooling a lubricating oil lubricating the reduction gear for the mill, the radiator being arranged in a downstream side of the cooling fan.

In preferable, the reduction gear for the mill has a radiator portion, an oil pump portion and a filter portion which are sectioned as blocks, and the blocks are connected to each other via a flexible pipe.

In order to achieve the object mentioned above, in accordance with a second aspect of the present invention, there is provided a reduction gear for a mill which is provided in a coal mill for pulverizing raw material coal introduced between a roller and a ring, comprising a cooling fan which is provided in an input shaft of the reduction gear for the mill connected to a motor, and a radiator for cooling a lubricating oil lubricating an inner portion of the reduction gear for the mill, the radiator being arranged between the cooling fan and a case of the reduction gear for the mill.

Further, it is desirable that the case of the reduction gear for the mill is extended to a side of the input shaft, the radiator is arranged in each of an upper portion and both side portions of the extending portion, and the radiators are connected in series by using a pipe, or the radiator is constituted by winding a pipe within which the lubricating oil is communicated around a periphery of the extending portion at several times.

Further, the structure may be made such that the radiator is sectioned as blocks, an oil pump portion and a filter portion which are sectioned as blocks are provided, and the blocks are connected to each other via a flexible pipe. Further, in preferable, each of the blocks is mounted to the case of the reduction gear via vibration isolating means.

Further, in preferable, a detachable filter cartridge is arranged between the radiator and the cooling fan, or a filter cartridge has an area which covers a front surface in a side of the cooling fan of the radiator.

Further, it is desirable that a first duct which covers a periphery of the cooling fan and a second duct which covers a periphery of the radiator are provided, and the first duct is formed in a shape which smoothly expands from an outer peripheral portion of the cooling fan to a front surface in a side of the cooling fan of the radiator, or the second duct is formed in a shape such that a cross-sectional area of air flow thereof gradually expands in a side of a back surface of the radiator (in an opposite side of a surface opposing to the cooling fan).

DETAILED DESCRIPTION OF THE INVENTION

A description will be given below of an embodiment according to the present invention with reference to the accompanying drawings.

Figure 1:
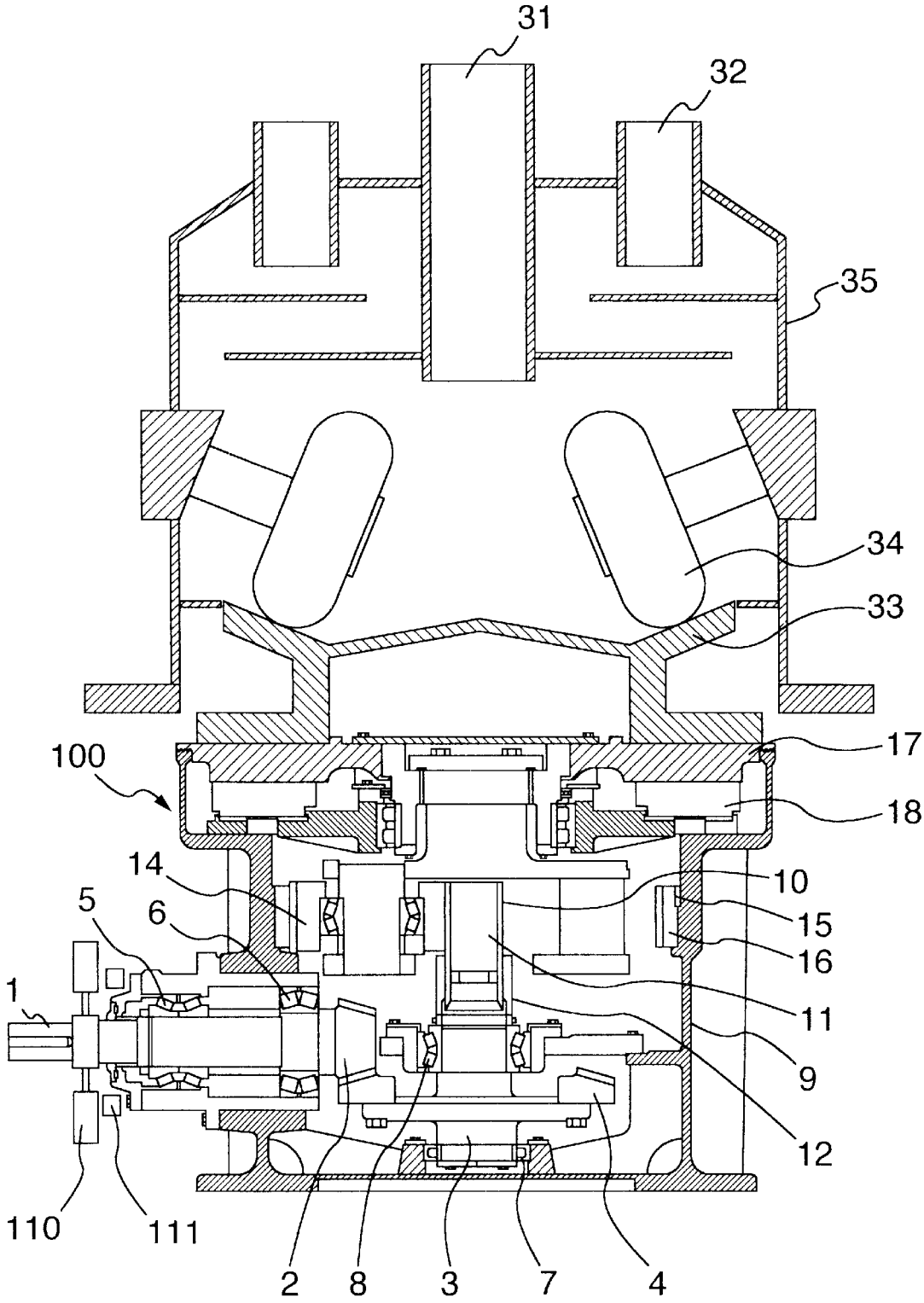
FIG. 1 is a vertical cross sectional view of an embodiment of a coal mill in accordance with the present invention.

FIG. 1 is a vertical cross sectional view of an embodiment in which a reduction gear for a mill is arranged in a lower portion of a coal mill. In the coal mill, in order to improve an efficiency of combustion in a thermal power plant, raw coal is pulverized into fined particles to a level which can be passed through a 200 mesh filter. Then, the coal mill is provided with a raw coal inlet 31 through which the raw coal is input, a pulverized coal outlet 32 from which pulverized coal is taken out, a yoke 33 which is mounted to an output table 17 in the reduction gear, a plurality of rotatable roller tires 34 and a mill housing 35. A size of the reduction gear for the mill is typically set to a large size having a total height of about 1500 mm, a total width of about 1500 mm and a total length of about 2000 mm.

The coal input from the raw coal inlet 31 is pulverized between the yoke 33 and the roller tires 34, and the pulverized coal is taken out from the pulverized coal outlet 32 and is supplied to a boiler (not shown). At this time, the reduction gear supports all the downward load generated at a time of pulverizing the coal via the yoke 33. Accordingly, a great deal of bearing load is applied to a thrust supporting portion of a tilting pad type thrust bearing 18, and a load applied to a tooth surface of each of gears constituting the reduction gear becomes greater than that of a reduction gear for a general industry such as a pump or the like. In correspondence to an increase of the load, a lubricating oil having a higher viscosity is employed for a lubricating oil therefor.

In this case, an illustration is omitted, however, a plurality of coal mills mentioned above, generally about five or six coal mills are arranged within the same power plant. Further, in order to prevent vibration or the like, the coal mill is arranged in a space surrounded by concrete columns and the reduction gear for the mill is mounted to the lower portion of the mill.

In the reduction gear for the coal mill, a great thrust load is applied to the thrust bearing at a time of pulverizing the raw coal. As well as the matter, a loss of a power transmission is generated in a power system which drives the pulverizing ring or the roller. Due to these reasons and a heat application for removing water within the raw coal, a portion near the coal mill equipment becomes a high temperature. For example, in a certain trial calculation, when pulverizing the raw coal of 10° C. in the coal mill, a temperature of the discharge gas is 57° C. and a temperature of an air for heating reaches 420° C. Since this heating air is fed near the roller portion of the coal mill, the reduction gear portion disposed below the roller portion of course has a high atmospheric temperature. Further, since the thrust load and the transmitting power of the coal mill are large, a lot of heat is generated in the gear and the bearing, so that it is essential to feed a lubricating oil having a low temperature to the lubricating portion.

Accordingly, an oil cooler, an oil pump, a line filter and an oil tank have been conventionally provided in the reduction gear for the mill, thereby supplying the lubricating oil having a low temperature from the lubricating oil supply unit. Then, in order to cool the lubricating oil in the oil cooler, the cooling water is introduced to the oil cooler. At this time, the cooling water is circulated in a circulating passage which is again returned to the oil cooler and reused after being collected in a cooling tower provided in a place apart from the coal mill apparatus and being cooled. In this case, since the reduction gear for the mill is placed between the concrete columns, the lubricating oil supply unit is arranged in an outer side of the concrete column so as to connect by piping between the lubricating oil apparatus and the reduction gear. As a result, a space for the lubricating oil system is required, and the unit becomes complex.

In this case, in the reduction gear 100 for the mill, since the raw coal is ground down, a great vibration is generated at a time of pulverizing. Further, since it is hard to completely prevent the fined coal from leaking out from the mill case, the fine dusts are leaked out from the mill case. That is, in the reduction gear for the mill, an environment in which the reduction gear is used is severe in comparison with that of the reduction gear used in the general industrial plant. In spite of bad conditions such as a high temperature, a lot of dusts, a lot of vibration, a high load for driving the reduction gear and the like, it is strongly desired to structure the lubricating oil system to be cooled by air in order to save space of the reduction gear for the mill and intend to simplify the reduction gear for the mill.

Figure 2:
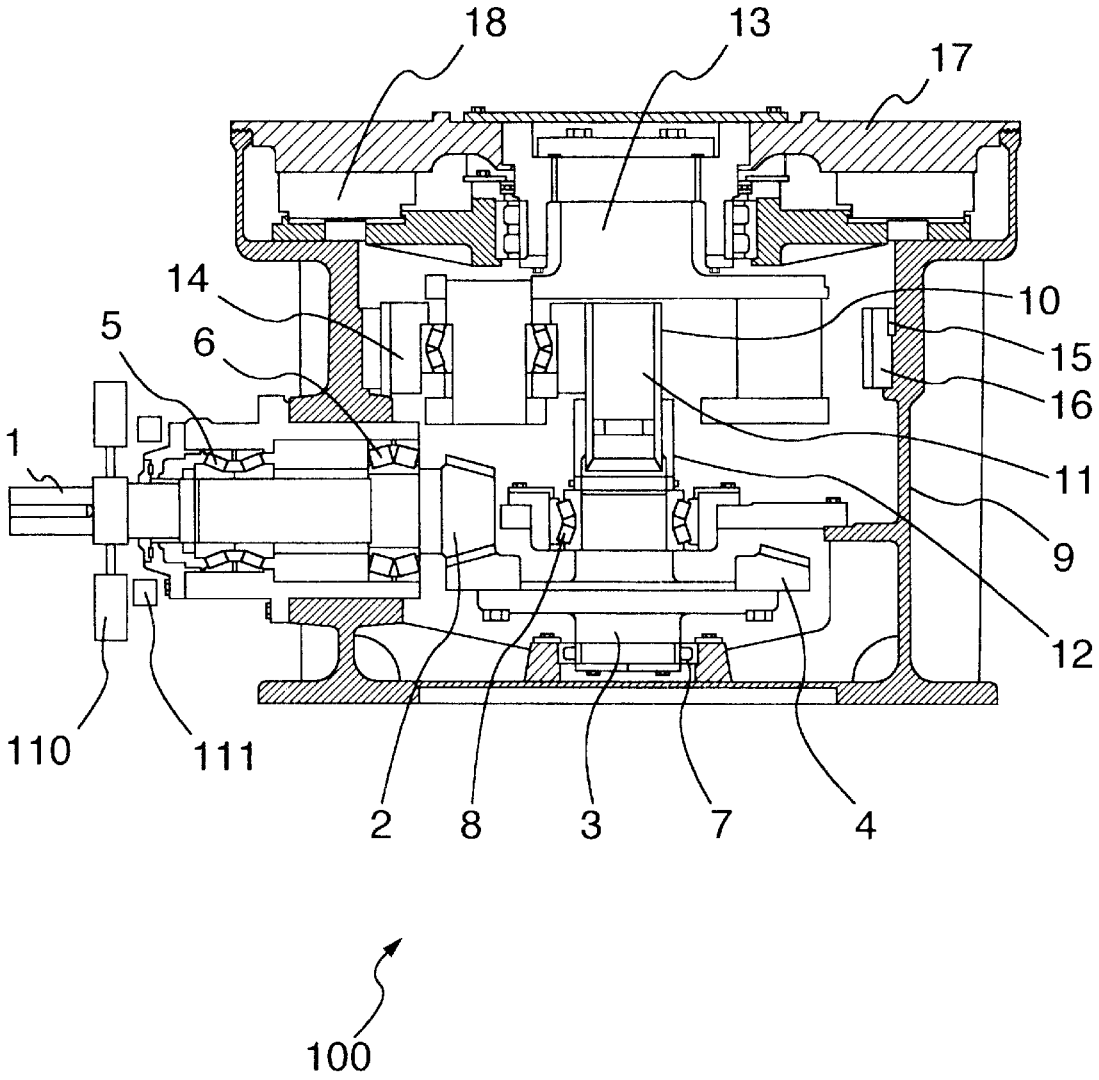
FIG. 2 is a vertical cross sectional view of an embodiment of a reduction gear for a coal mill in accordance with the present invention.
Figure 3:
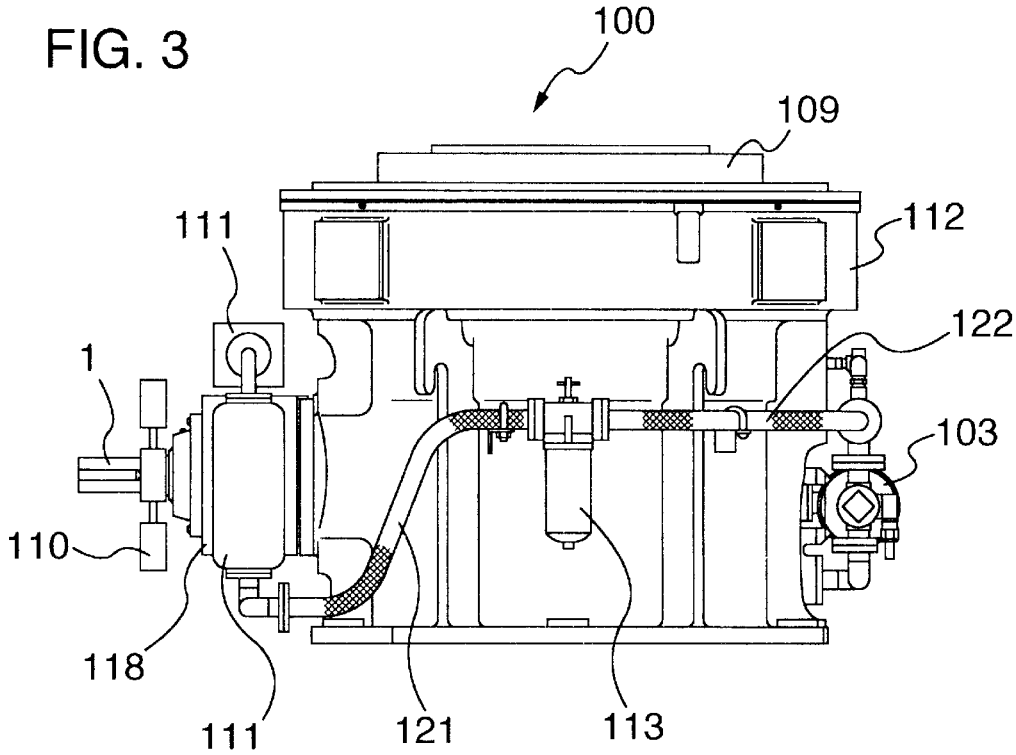
FIG. 3 is a plan view of the reduction gear shown in FIG. 2.

In accordance with the present invention, a cooling fan 110 is provided in the reduction gear so as to cool by air. This embodiment will be described with reference to FIGS. 2 and the like. FIG. 2 is a vertical cross sectional view of an air-cooling reduction gear and FIG. 3 is a front elevational view thereof. A reduction gear for a mill illustrated in this drawing is a two-stage reduction gear. A bevel pinion 2 is fixed to a front end of an input shaft 1 and a bevel gear 4 is fixed to an intermediate shaft 3. The bevel pinion 2 and the bevel gear 4 are meshed with each other, and a rotation of the input shaft 1 is reduced and transmitted to the intermediate shaft 3. The input shaft 1 is supported to a cylindrical case 9 via bearings 5 and 6 and the intermediate shaft 3 is supported to the cylindrical case 9 via bearings 7 and 8. The intermediate shaft 3 is spline connected to a sun gear shaft 11, to which a sun gear 10 is fixed and which rotates the sun gear 10, by a coupling 12. Further, a lower end surface of the sun gear shaft 11 is formed in a spherical shape. The sun gear 10 is meshed with three planetary gears 14 which are supported to a carrier 13. The planetary gears 14 are meshed with internal gears 16 which are fixed to the cylindrical case 9 at a plurality of portions by using pins 15. The carrier 13 is spline connected to an output table 17. The output table 17 is supported to the cylindrical case 9 via a thrust bearing 18 formed in a tilting pad shape. Further, the carrier 13 supports three planetary gear 14. The sun gear shaft 11, three planetary gears 14 and the internal gears 16 constitute a planetary gear apparatus. A cooling fan 10 having a diameter of about 700 mm is fitted to the input shaft 1 of the reduction gear for the mill structured in this manner so as to cool the lubricating oil and the reduction gear case.

An end portion of the input shaft 1 is directly connected to an electric motor (not shown) via a coupling. Accordingly, power of rotation input from the input shaft 1 is reduced in velocity by the bevel gears and the planetary gears constituting the reduction gear for the mill and is transmitted to the mill pulverizing ring portion from an output shaft 109. The lubricating oil supply unit and the cooling apparatus are provided in a reduction gear 100 for the mill in a compact manner. In this case, a gear case 112 of the reduction gear for the mill commonly serves as an oil tank. The lubricating oil which lubricates the gears and the bearings within the reduction gear 100 for the mill is fed to a line filter 113 which is placed in a side surface of the reduction gear for the mill, by an oil pump 103 which is positioned in a back surface side of the reduction gear for the mill. Then, the abraded particles and the like are filtered by the line filter 113. A filtered clean lubricating oil is fed to a radiator 111 which is provided in a side of the input shaft 1 of the reduction gear 100 for the mill. The lubricating oil in which a heat is discharged by the radiator 111 and a temperature is reduced is fed to the tooth surface of each of the gears and the bearings which constitute the reduction gear. A cool wind is fed to the radiator 111 from the cooling fan 110 and cools the lubricating oil by exchanging heat with the lubricating oil flowing through the inner portion thereof.

In this case, in the reduction gear 100 for the mill, in order to support the downward load generated in the mill pulverizing portion, a lubricating oil having a high viscosity is employed. Accordingly, when using the radiator which is employed in the general industry, a pressure loss is increased and a defined lubricating oil pressure can not be obtained. Then, in accordance with the present embodiment, in place of the oil pump having a discharge pressure of 0.5 Mpa which has been conventionally employed, an oil pump having a discharge pressure of 0.75 Mpa is used.

Further, a vibration generated at a time of pulverizing the raw coal in the mill is transmitted to the reduction gear 100 for the mill. Then, the oil pump portion 103, the line filter 113 and the radiator 111 are sectioned as blocks, respectively. Then, when mounting each of the blocks to the main body of the reduction gear for the mill, a vibroisolating rubber is interposed in the mounting portion so as to insulate the vibration. Further, flexible pipes 121 and 122 are used as a part of the pipe which connects each of the blocks. Since the flexible pipe portions isolate the vibration, it is possible to prevent the vibrations of the oil pump portion, the line filter portion and the radiator portion from being transmitted to the pipe and breaking the pipe even if the phases of the vibration in the respective blocks are different from each other.

Figure 4:
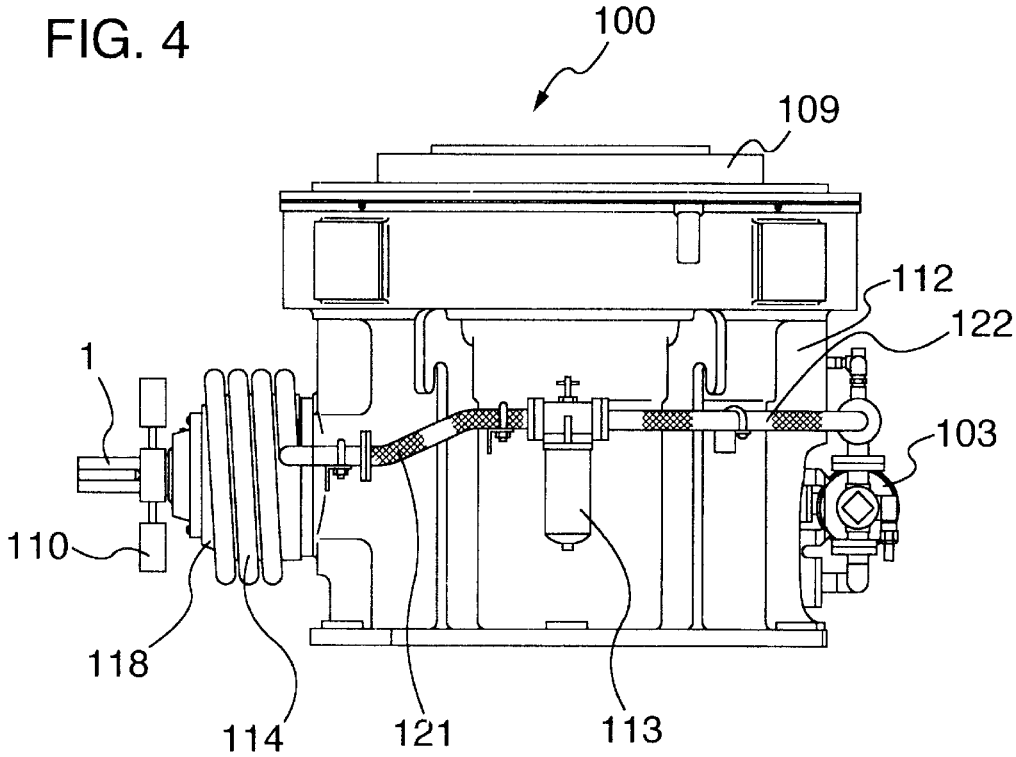
FIG. 4 is a plan view of another embodiment of a reduction gear for a coal mill in accordance with the present invention.

Next, a description will be given of another embodiment in accordance with the present invention with reference to FIG. 4. The present embodiment is different from the embodiment mentioned above in view that the feeding pipe for the lubricating oil is utilized as a cooling pipe 114. A casing 118 in the input shaft 1 of the reduction gear 110 for the mill is extended in an axial direction, the cooling pipe 114 is spirally wound around the casing 118 and the cooling air fed from the cooling fan 110 is introduced to the cooling pipe 114. A path of the pipe is made long and a heat exchanging area with the cooling air is increased, thereby improving a cooling effect. Also in the present embodiment, in the same manner as the embodiment mentioned above, the oil pump 103, the line filter 113 and the radiator (the cooling pipe) 114 are sectioned to blocks, and the vibroisolating rubber is interposed in the mounting portion of each of the blocks, thereby intending to insulate the vibration. Further, to a part of the pipe which connects each of the blocks is applied flexible pipes 121 and 122, thereby isolating the vibration.

Figure 5:
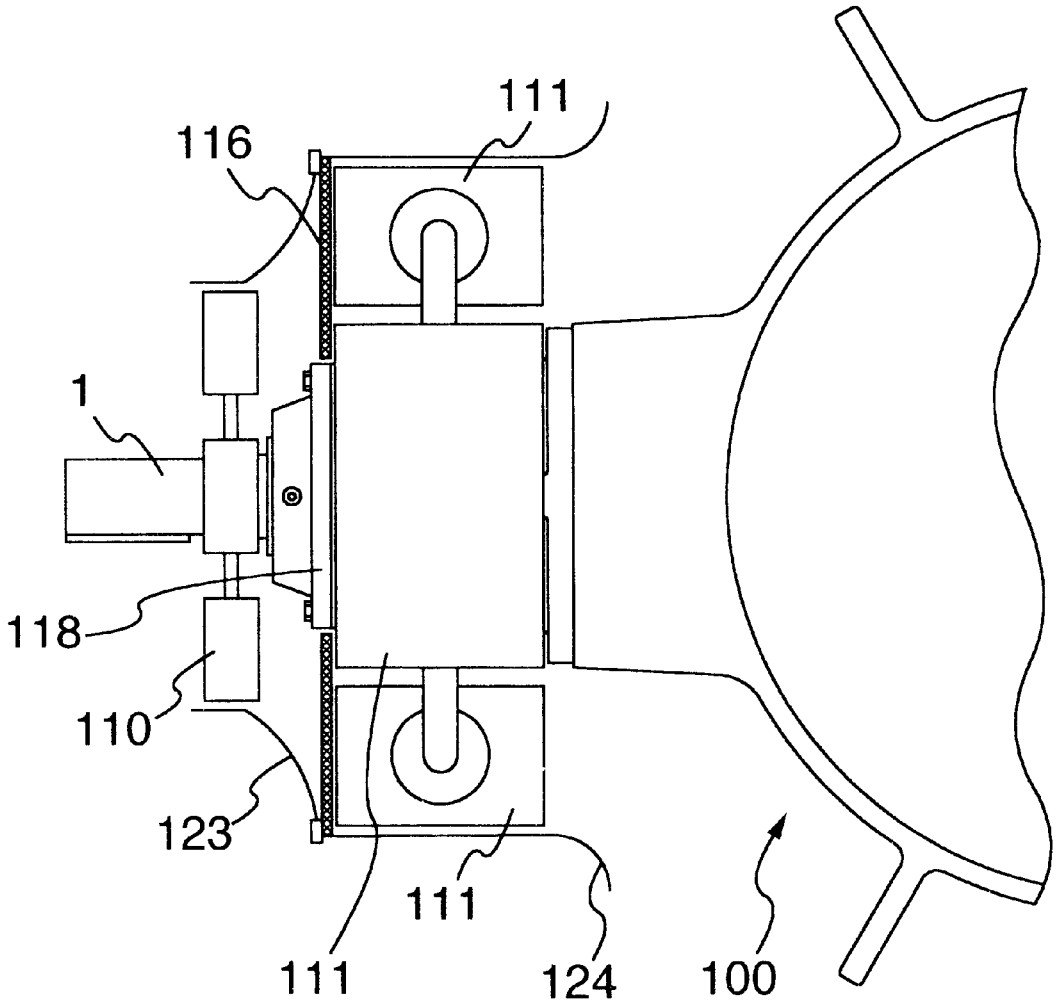
FIG. 5 is a top view of the other embodiment of a reduction gear for a coal mill in accordance with the present invention.

A description will be given of the other embodiment in accordance with the present invention with reference to FIG. 5. FIG. 5 is a top view of a reduction gear for a coal mill. The present embodiment is different from the embodiments mentioned above in view that ventilating ducts 123 and 124 are provided in a front portion and an outer peripheral portion of the radiator 111 arranged in a side of the input shaft 1 of the reduction gear 100 for the mill so as to form a flow passage which introduces the cool wind fed from the cooling fan 110 and the air filter 116 is provided in an upstream side of the radiator 111. Accordingly, the dusts and the like within the machine place in which the coal mill is placed are prevented from being attached to or accumulated in the radiator 111. In this case, a gentle curve in which the cool wind can efficiently flow is desirable for the shape of the ventilation duct.

Further, since in the radiator, the cool wind passing through the radiator exchanges heat with the lubricating oil which lubricates each of the elements in the reduction gear 100 for the mill and thermally expands, the flow of the cool wind is easily prevented. Then, in the downstream side of the radiator 111, it is desirable to form the shape of the ventilation duct 124 in a shape in which a cross sectional area gradually increases in a flow direction. Further, it is desirable that the air filter 116 covers the front surface side of the radiator 111. Accordingly, it is possible to prevent the dusts from being attached to and accumulated in the inner portion of the radiator 111.

The radiator 111 is provided in the downstream side of the cooling fan 110 in the side of the input shaft 1, however, at this time, the radiator 111 is arranged in an upper portion and both right and left side surfaces of the casing 118 and the radiators 111 are connected by the pipe therebetween. Then, the air filter 116 is constructed in a cartridge structure. Since no radiator is disposed below the casing 118, it becomes easy to mount the air filter 116, and it is possible to pull out the cartridge from the upper portion or the side surface of the ventilation duct 124, whereby it is possible to easily replace the cartridge. Accordingly, a daily inspection can be easily performed, no expert operator is required and it is possible to reduce a cost for a maintenance. In this case, if the cartridge of the radiator 111 is structured such as to be capable of being reused due to cleaning and the like, the earth environment can be maintained. Further, it is a matter of course that the radiator may be also arranged below the casing 118 when increasing a capacity of the radiator.

In accordance with the present invention, in the reduction gear system for the coal mill the case of reduction gear for the mill can be integrated with the lubricating oil supply unit, whereby it is possible to save space and realize a low cost in view of the total system.

What is claimed is:

1. A reduction gear which is provided in a coal mill for pulverizing raw material coal introduced between a roller and a ring, comprising a cooling fan which is provided in an input shaft of the reduction gear for the mill connected to a motor, and a radiator for cooling a lubricating oil lubricating an inner portion of the reduction gear for the mill, the radiator being arranged between the cooling fan and a main body of the reduction gear for the mill.

2. A reduction gear for a mill as claimed in claim 1, wherein said main body of the reduction gear for the mill is extended to a side of the input shaft, said radiator is arranged in each of an upper portion and both side portions of the extending portion, and the radiators are connected in series by using a pipe.

3. A reduction gear for a mill as claimed in claim 1, wherein said main body of the reduction gear for the mill is extended to a side of the input shaft, and the radiator is constituted by winding a pipe within which the lubricating oil is communicated around a periphery of the extending portion at plural times.

4. A reduction gear for a mill as claimed in claim 1, wherein said radiator is sectioned as blocks, an oil pump portion and a filter portion which are sectioned as blocks are provided, and the blocks are connected to each other via a flexible pipe.

5. A reduction gear for a mill as claimed in claim 4, wherein each of said blocks is mounted to the main body of the reduction gear via vibration isolating means.

6. A reduction gear for a mill as claimed in claim 1, wherein a detachable filter cartridge is arranged between said radiator and said cooling fan.

7. A reduction gear for a mill as claimed in claim 6, wherein said filter cartridge has an area which covers a front surface in a side of said cooling fan of the radiator.

8. A reduction gear for a mill as claimed in claim 1, wherein a first duct which covers a periphery of said cooling fan and a second duct which covers a periphery of said radiator are provided, said first duct being formed in a shape which smoothly expands from an outer peripheral portion of the cooling fan to a front surface in a side of the cooling fan of the radiator.

9. A reduction gear for a mill as claimed in claim 8, wherein said second duct is formed in a shape such that a flow cross sectional area thereof gradually expands in a side of a back surface of the radiator.

* * * * *